United States Patent [19]

Wicker

[11] Patent Number: 4,493,157

[45] Date of Patent: Jan. 15, 1985

[54] METHOD OF AUTOGENOUSLY DRYING COAL

[75] Inventor: Gordon R. Wicker, Lakewood, Colo.

[73] Assignee: Amax Inc., Greenwich, Conn.

[21] Appl. No.: 523,377

[22] Filed: Aug. 15, 1983

[51] Int. Cl.[3] ..... F26B 3/08

[52] U.S. Cl. ..... 34/10; 432/14

[58] Field of Search ..... 432/14, 15, 58; 34/10; 110/245, 347

[56] References Cited

U.S. PATENT DOCUMENTS

| | | | |
|---|---|---|---|
| 3,985,516 | 10/1976 | Johnson et al. | 34/10 |
| 4,192,650 | 3/1980 | Seitzer | 34/10 |
| 4,213,752 | 7/1980 | Seitzer | 432/14 |
| 4,324,544 | 4/1982 | Blake | 110/347 |
| 4,325,833 | 4/1982 | Scott | 110/347 |

*Primary Examiner*—Henry C. Yuen

*Attorney, Agent, or Firm*—Roland T. Bryan

[57] ABSTRACT

There is disclosed a method for drying coal, particularly sub-bituminous coal in a packed bed configuration, wherein coal is ventilated by an oxygen-containing gas so that there is a heated zone wherein autogenous drying occurs. In particular, counter current ventilation is used to accomplish preheating, drying and evaporative cooling in three contiguous subzones. The process for drying provides for regulating the movement of coal and the flow of incoming air so as to achieve by exothermic oxidation a temperature not greater than 250° F.

4 Claims, 1 Drawing Figure

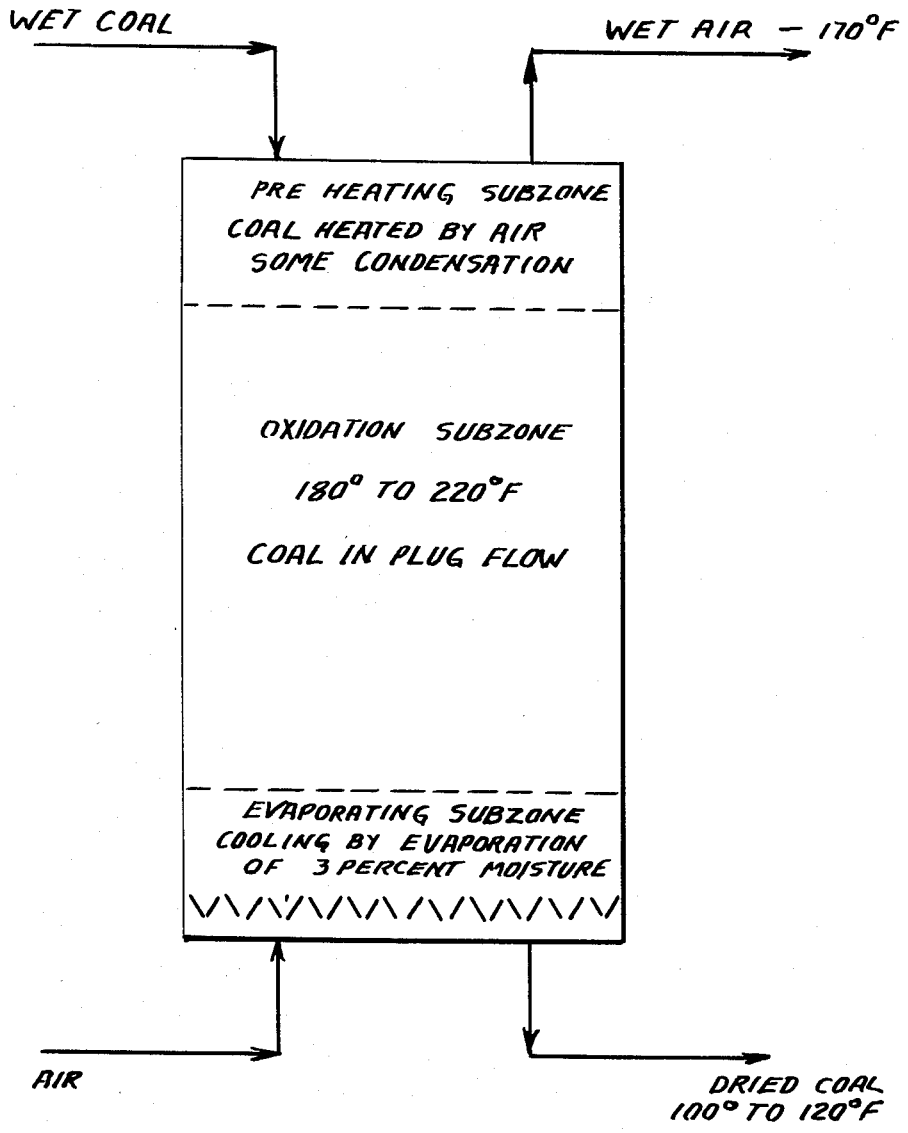
WET COAL
WET AIR — 170°F
PRE HEATING SUBZONE
COAL HEATED BY AIR
SOME CONDENSATION
OXIDATION SUBZONE
180° TO 220°F
COAL IN PLUG FLOW
EVAPORATING SUBZONE
COOLING BY EVAPORATION
OF 3 PERCENT MOISTURE
AIR
DRIED COAL
100° TO 120°F

METHOD OF AUTOGENOUSLY DRYING COAL

BACKGROUND OF THE INVENTION

The present invention relates to a process for drying wet coal and particularly sub-bituminous coal of the type that, as mined, would have about thirty percent moisture. More particularly, the invention relates to the drying of coal having a size of two inches or less wherein the heat for dyring the coal is provided by exothermic oxidation in air at temperatures of about 180° to 200° F. and not greater than 250° F.

PRIOR ART

Sub-bituminous coal typically found in the western United States contains about twenty to thirty percent internal moisture as mined, and is not usually dried prior to shipment and use. However, drying is desirable to lower the shipping cost and to make the coal more competitive with the lower moisture content bituminous coals that are typically used for steam generation.

A fairly common system for drying coal is to crush it to a size of one half inch and finer, and then fluidize the fine coal so as to cause the mixture of gas and coal to act as a fluid. Such a technique is employed in the process described in U.S. Pat. No. 2,638,684, and has found wide use in coal drying.

An oxidizing fluid bed drying system has been described in U.S. Pat. No. 4,324,544, in which coal that has been finely crushed is maintained in a fluidized bed and is raised to a temperature of between 400°-600° F. by combustion occurring within the bed. This process has a disadvantage in that the required fine crushing and subsequent attrition adversely affects the handling properties of the coal.

Another example of a coal drying process is that shown in U.S. Pat. No. 4,213,752 in which the coal is also crushed to a fine size so that it may be maintained as a fluidized bed and combustion occurs at a temperature range of 200°-300° C. (392°-577° F.) with hot gases being recycled from the fluidized bed and reintroduced to dry the wet coal entering the fluidized bed. This process suffers from the same disadvantages of the previous one.

The moisture found in sub-bituminous coals is largely contained within the coal particles. As a result, it was believed that drying below 212° F. would be prohibitively slow. In contradistinction, it has been found that drying at higher temperatures tends to create pressure within particles and to cause comminution. This adds to the cost of particulate removal from the gas stream.

SUMMARY OF THE INVENTION

The present invention is for a method of slowly drying as-mined coal which has a size of two inches and smaller and which contains about thirty percent moisture, where the low temperature reaction of the coal is utilized as the primary means to drive off the moisture. Thus, the invention uses slow moving air in contact with the coal in a counterflow arrangement to create a substantially adiabatic autogenous drying zone in a packed bed wherein the exothermic oxidation of the coal provides the heat required for drying. This is done at a temperature of less than 250° F. Each coal has a characteristic oxidation reactivity rate curve (vs. temperature of coal) in the presence of air, and it is this characteristic that is employed as the source of heat to drive off the moisture from the coal. As this is a slow reaction it results in relatively slow drying and requires very low air flow rates.

This slow drying approach has several advantages over the prior art. It does not require the extent of crushing that the prior art fluidized bed drying systems require. It also does not require the continual levitation and agitation of coal during the drying process, nor gas recycling apparatus, nor gas cleaning systems, that are typically associated with the prior art.

Accordingly, in the preferred embodiment the simpler, more economic results of the present method are achieved by passing wet coal, countercurrent to a flow of air, through a substantially adiabatic autogenous drying zone, comprising vertically disposed contiguous subzones consisting of preheating, oxidation and evaporative cooling subzones. Within the preheating zone, hot and moist air heats the coal. Within the oxidation zone, exothermic oxidation of the coal provides the large energy required for the evaporation of water from the coal. Within the evaporative cooling subzone, the coal is cooled partly by evaporation, and partly by supplying heat to the incoming cold air. The heated moisture-laden gas is removed from the upper preheating zone, and the dried coal is removed from the lower evaporative subzone.

The entire process can be controlled by regulating the flow of coal into the adiabatic autogenous drying zone while maintaining substantially constant the flow of incoming air so as to achieve exothermic oxidation at a temperature in the oxidation subzone which typically is about 180°-220° F., but not greater than about 250° F. In the oxidation subzone the heat generated is such that six parts of water by weight are evaporated for each part of oxygen of the air that is consumed.

The rate of oxidation in the oxidation zone, and hence the rate of drying, is determined by coal reactivity, temperature, and oxygen concentration. The throughput capacity of a dryer might therefore be either limited or maximized by control of ventilation. When the coal is sub-bituminous, the rate of oxidation can be sufficient to dry one percent of moisture with reference to the wet coal per hour.

DESCRIPTION OF THE INVENTION

The various features of novelty and of the invention which characterize it are pointed out with particularity in the claims annexed to and forming a part of the specification. For a better understanding of the process, its advantages and objects obtained by its use, reference should be had to accompanying drawing and description.

FIG. 1 is a diagram illustrating the counterflow adiabatic autogenous drying zone of the process.

The invention rests primarily on the discovery that coal may be exothermically oxidized in a moving packed bed at temperatures less than 250° F., even when the coal contains significant amounts of moisture. Although the contemplated invention utilizes this exothermic heat it is not important to the invention that there be no external heat surce or heat loss. However, in the practical embodiment the reaction is essentially adiabatic. Thus, the invention process can be illustrated with reference to the schematic diagram of FIG. 1 in which the black outside line represents a packed bed container of a conventional type having a separate entrance at the top for the incoming wet coal and a separate outlet for the exiting moisture laden air. The typical reaction vessel will be vertically oriented and may be insulated so as to minimize heat loss.

The bottom portion of the reaction vessel will have a separate entrance for the upflowing ambient air and a separate outlet for the dried coal exiting therefrom. Likewise, the upper end of the reaction vessel will have a seperate opening for the incoming moist coal and the outgoing heated air. For a description of such a conventional gravity vessel please make reference to PERRY'S CHEMICAL ENGINEERS HANDBOOK, 4th Ed. McGraw Hill, Chapter 20, p.35, FIGS. 20–44 therein.

In the carrying out of the drying process according to the present invention using a moving packed bed dryer as illustrated in FIG. 1 there are three subzones that are continuously superjacent each other. The upper one has the incoming wet coal, containing moisture in the order of thirty percent, moving through the heated gases that are rising. As the heated gases contain substantial amounts of moisture from the contact with coal in the lower zones some condensation may occur and this upper zone has been termed the pre-heated subzone because the coal is being preheated before the oxidation occurs. In the middle of the diagram and by far the largest portion of the rector vessel length is called the oxidation subzone and immediately below it is the portion which is called the evaporation subzone which is limited to the lower portion of the reaction vessel.

As related to the diagram of FIG. 1 it can be seen that the invention contemplates the use of a characteristic oxidation temperature in the oxidation subzone of between 180°–220° F., but in no event greater than 250° F. Within this subzone there is generated nearly all of the process heat that is required for the vaporization of the water. Thus, the differences of temperature between the air and coal temperature are not very great because the heat being generated within the coal particles by the exothermic oxidation reaction is used to evaporate the external and internal water of the coal particles. This is in contrast to the high temperature differences generally employed in the prior art. As a result, decrepitation of coal is minimized in the present invention.

Accordingly, in a preferred embodiment in which sub-bituminous coals are to be dried with the incoming coal having approximately thirty percent moisture, and where the oxidation drying subzone is maintained of a sufficient length, the exiting coal will have a moisture content of approximately ten percent. Further, from the overall rate viewpoint, by the utilization of this process the slow drying rates for typical sub-bituminous coal and lignite are limited by the oxidative reactivity of these fuels to about one percent of water on a wet coal basis per hour. Thus, the total required retention time for coal (including the preheat and cooling zones) in such a dryer would depending upon the reactivity of the coal being dried, be about 24 to 48 hours. Ventilation rates are typically less than one foot per second.

Although the process has been described as it would be carried out in a simple vertically arranged packed bed reactor, the process can be effectively used in a horizontal tunnel dryer or in a series of separate packed bed reactors with the air being caused to flow serially through each reactor. In these alternatives the rate of air flow can be regulated so that the condition within the dryer and the drying rate is the same as the prior example.

The relatively low temperature of the reaction process, the simplicity of gravitational flow, the unneeded gas cleaning systems and the avoidance of a necessity to crush the coal prior to drying will yield a low capital, simply operated process. Thus an economic process of drying coal is achieved.

To further illustrate the application of the invention process, note the following examples when applied to two widely different coals:

EXAMPLE 1

A sub-bituminous coal, having a gross heating value of 8,400 Btu/lb and a moisture content of 29 percent, is intermittently charged into and removed from a well-insulated column, such that its average retention time within the column is 42 hours. The column is ventilated, countercurrently to the movement of coal, with air at a mass flow rate equal to one-half that of the coal fed to the column.

The moisture content of the coal is reduced from 29 percent to 12.5 percent, and its gross heating value is increased to 10,300 Btu/lb. The maximum temperature within the column is 206° F. The air is discharged from the column saturated with water at 154° F.

EXAMPLE 2

A North Dakota lignite, having a gross heating value of 7,150 Btu/lb and a moisture content of 34 percent, is intermittently charged into and removed from a well-insulated column, such that its average retention time within the column is 27 hours. The column is ventilated with air at a mass flow rate equal to three-fourths that of the lignite fed to the column.

The moisture content of the lignite is reduced from 24 percent to 16 percent, and its gross heating value is increased to 9,300 Btu/lb. The maximum temperature within the column is 198° F. The air is discharged from the column saturated with water at 162° F.

The present invention may be embodied in other more specific forms of apparatus, and the various steps of performing the process may be used in equivalent form without departing from the spirit or the essential attributes of the invention. Accordingly reference should be made to the appended claims for the scope of the invention.

I claim:

1. A method of drying as-mined coal having a size two inches and less and containing about thirty percent moisture comprising:

(a) providing said coal in an autogenous drying zone having subzones consisting of a preheating, an oxidation and an evaporative cooling subzones, (b) passing in a uniformly distributed manner, ambient air into said evaporative subzone such that the coal and said gas are moving countercurrent to each other, and exothermic oxidation of the coal occurs in the oxidation subzone to produce heated flowing gases and dried coal, whereby in the evaporative subzone the heated dried coal further dries by evaporating moisture therefrom and the heated gases in said preheating zone heat the incoming moist coal, (c) removing the heated moisture laden gases from the preheating zone, (d) removing the dried coal from the evaporative subzone, and (e) regulating the movement of air relative to the coal in said autogenous drying zone to achieve by exothermic oxidation a temperature of the gases in the oxidation subzone of about 180° to 220° F. and not greater then about 250° F. and yielding dried coal containing from 5 to 15 percent moisture.

2. A method according to claim 1 in which the subzones are vertically contiguous.

3. A method as in either claims 1 or 2 in which the coal is stationary during drying and the air is moving.

4. A method as in either claims 1 or 2 in which the coal is continuously moving downward and the air is flowing countercurrent to such movement.

* * * * *